US005179988A

United States Patent [19]

Vorsmann

[11] Patent Number: 5,179,988

[45] Date of Patent: Jan. 19, 1993

[54] ROLLING SHUTTER FOR COVER PART OF WALL OR ROOF OPENING, ESPECIALLY FOR ROOF WINDOW

[76] Inventor: Franz Vorsmann, Marsberger Str. 14, 3538 Marsberg 4,, Fed. Rep. of Germany

[21] Appl. No.: 795,657

[22] Filed: Nov. 21, 1991

Related U.S. Application Data

[63] Continuation of Ser. No. 479,355, Feb. 13, 1990, abandoned.

[30] Foreign Application Priority Data

Feb. 13, 1989 [DE] Fed. Rep. of Germany ... 8901614[U]

[51] Int. Cl.[5] ..... E04F 10/06

[52] U.S. Cl. ..... 160/32; 160/133

[58] Field of Search ..... 160/32, 133, 33, 31, 160/90

[56] References Cited

U.S. PATENT DOCUMENTS 4,683,932 8/1987 Bubendorff ..... 160/133
4,691,753 9/1987 Baier ..... 160/32
4,760,873 8/1988 Bubendorff ..... 160/32
4,846,242 7/1989 Baier ..... 160/32
4,883,109 11/1989 Sonderby ..... 160/32

*Primary Examiner*—David M. Purol
*Attorney, Agent, or Firm*—Michael J. Striker

[57] ABSTRACT

A rolling shutter for a roof or wall window includes an apron, a shaft for rolling up and unrolling the apron, and two spaced lateral supports fixed with respect to the window for rotatably supporting the shaft. Two parallel side parts are rotatably supported in the two supports for rotation about an axis extending parallel to the shaft. The two side parts include guides for guiding the apron in rolling-up and unrolling movements thereof. The guides have rear extensions facing the shaft. An upper trim extends between the two side parts and is connected thereto for covering the apron from above. The rear extensions of the guides are spaced in all rotational positions of the two parts, from the shaft axis a distance substantially corresponding to a maximum radius of the shaft. The guides and the shaft define a space such that the apron can move freely therein without being damaged.

4 Claims, 4 Drawing Sheets

ROLLING SHUTTER FOR COVER PART OF WALL OR ROOF OPENING, ESPECIALLY FOR ROOF WINDOW

This is a continuation of application Ser. No. 479,355 filed Feb. 13, 1990 now abandoned.

BACKGROUND OF THE INVENTION

The present invention relates to a rolling shutter for a cover part of a wall or a roof opening, especially for a roof window, provided with a pivotable leaf. More particularly, it relates to such a rolling shutter which has a rolling shutter apron composed of rolling shutter blades or the like, a rolling shutter shaft for rolling up and unrolling the rolling shutter apron, two lateral supports in which the rolling shutter shaft is rotatably supported, two parallel side bars provided with guides for guiding the rolling shutter web, and supported turnably about an axis parallel to the rolling shutter shaft, an upper blind for covering the rolling shutter apron from above, and a rolling shutter actuating device.

Rolling shutters of the above mentioned type are known in the art and used in two variants. They serve mainly for closing of roof windows mounted in inclined roof surfaces and having blind frames fixedly mounted in the roof and a pivotable lead turnable or tiltable at least about a horizontal axis. Such roof windows are sometimes identified as roof residence window, roof surface window or the like.

In accordance with the first known variant disclosed for example in the German reference DE-OS 2,906,871 the side parts and a rolling shutter casing fixedly connected to it together form a structural unit which can turn as a whole about an axis arranged parallel to and at a distance from a rotational axis of the window leaf. For this purpose it is rotatably supported by a mounting bearing or hinge on an upper edge of the window or on the roof. Thereby high forces are used during opening of the window leaf, unfavorable mounting conditions of the rolling shutter casing arranged high over the roof, and presence of rotatable therewith rolling shutter shaft require use of complicated actuating devices partially only for opened window leaf, at least when an actuation of the rolling shutter with a hand crank or a motor or the like is desired.

The second known variant is disclosed for example in the German documents DE-OS 2,742,787 and 3,507,015 and is characterized in that a rolling shutter casing is fixedly mounted on the roof or on the frame of the window, and the side parts are mounted either rotatably as a whole on the rolling shutter casing or made from two portions which are connected with one another rotatably about an axis extending parallel to the turning axis of the window leaf and spaced from the latter, to allow the opening of the window leaf. Thereby considerable limitations in the sense of the operational comfort occur. Conventional rolling shutter aprons mounted in right-hand rotatable device can not be bent in the region of the rotatable connection of the side parts so much as desired for opening of the window leaf, or cannot fold without being destroyed when a rolling shutter blade or a shutter lamella is located in the region of the rotatable connections. Such rolling shutters can be used without danger of being damaged with actuation of the window leaf in left-hand rotatable device or only when the free rolling shutter end is pulled behind the rotational axis of the side parts or side portions.

SUMMARY OF THE INVENTION

Accordingly, it is an object of the present invention to provide a rolling shutter of the above mentioned general type, in which despite the utilization of a rolling shutter shaft which is rotatably supported in fixedly mounted supports, a relative wide opening of the window leaf is possible without the danger of damage to the rolling shutter apron.

It is also an object of the present invention to achieve this the swinging substantially independently of a respective closing condition of the rolling shutter and especially for right hand rotatable devices.

In keeping with these objects and with others which will become apparent hereinafter, one feature of the present invention resides, briefly stated, in that the side parts and at least a front portion of the upper window trim are supported rotatably so that in all rotational positions the rear extensions of the guides for the side parts have a distance from their axis which substantially corresponds to at least a maximum radius of the rolling shutter shaft.

The above described problems can be eliminated in accordance with the present invention with simple structural means. In contrast to the known solutions, the provision of a conventional rolling shutter casing which was considered as necessary for reliable sealing and has only small outlet slot at the front side for the rolling shutter apron, is dispensed with. Due to at least partial connection of the upper trim with the side parts, a free space is provided during apron rolling above and in front of the rolling shutter shaft. Thereby in contrast to the rigid rolling shutter casing, a corresponding rolling of the portion of the rolling shutter apron in the guides is possible. Thereby, a sufficient sealing similar to the utilization of a round approximately closed rolling shutter casing is obtained, and the rolling shutter apron is always guided in a deflection-free manner independently of a rotational angle and independently of respective diamater of the rolling shutter shaft.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
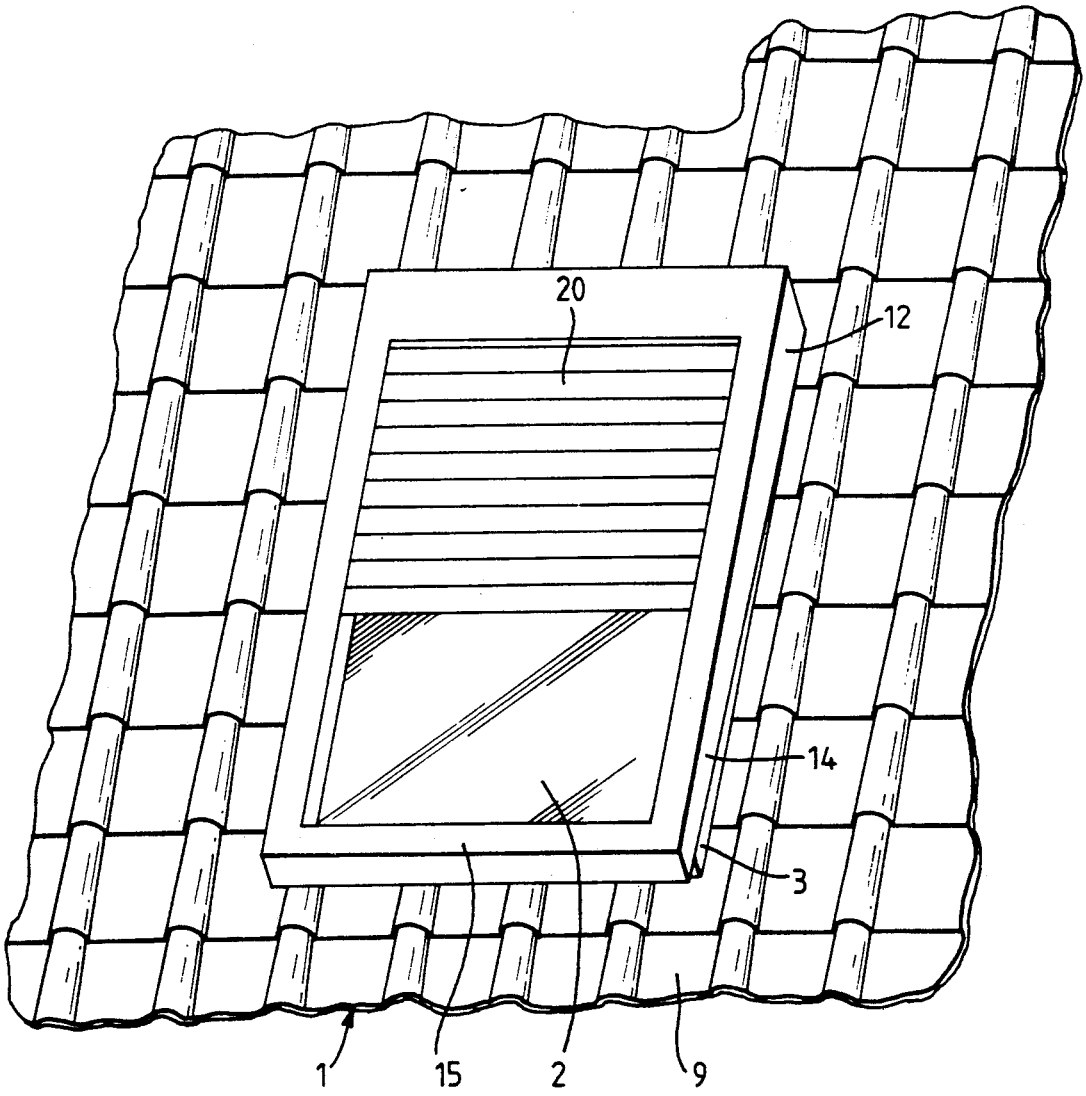
FIG. 1 is a perspective view of a roof window with with a rolling shutter in accordance with the present invention.

FIGS. 1–4 show a conventional roof window 2 mounted on a roof 1. The roof window 2 has a window frame 3 which surrounds a roof opening, and a window leaf 5 which is supported in the blind frame 3 rotatably about a central axis 4. Two lateral supports 6 are rigidly mounted above the window frame 3 on the roof 1. The supports are connected with one another for example by a lower trim 7 extending over the width of the window frame 3, to form a structural unit mountable rigidly on the roof 1. The lower trim 7 preferably has a cross-section 8 which is downwardly bent by 90° and after mounting on the roof 1 is covered with roof plates 9. Both supports 6 are composed for example of square or rectangular plates with upper edges which are curved along a curve 10 extending from behind forwardly and downwardly.

Figure 4:
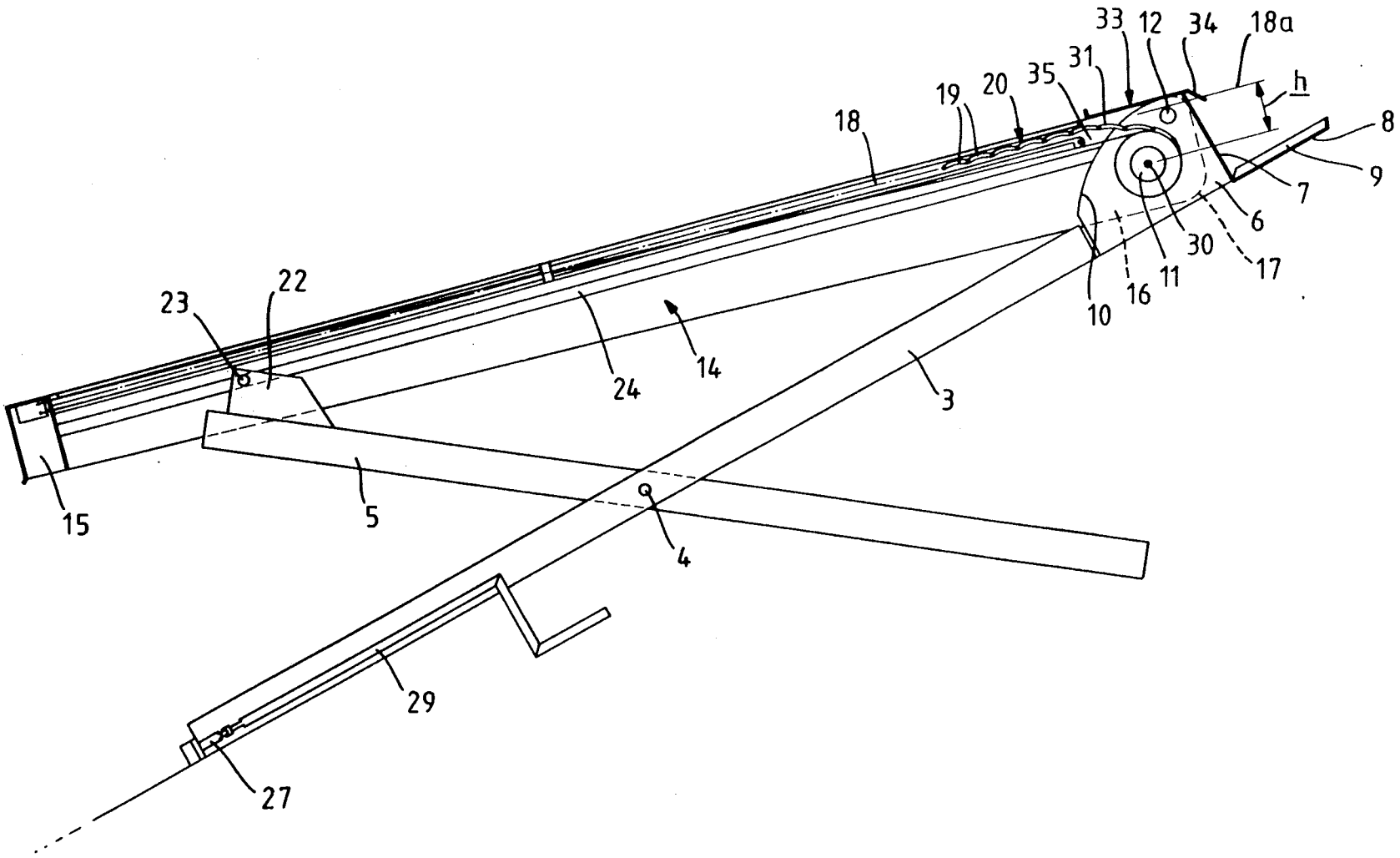
FIG. 4 is a side view substantially corresponding to the view of FIG. 2 but with the open roof window.

A shutter shaft 11 is located between the supports 6 and rotatably supported in the supports 6. Moreover, pivot pins 12 of side parts 14 are turnably supported in the supports 6. They are arranged parallel to one another at a distance corresponding to the distance between the lateral frame parts of the window frame, and connected at their front ends by a bottom crossbar 15 extending perpendicularly to them. The bottom crossbar 15 is formed for example as a hollow body projecting over the associated end of the window frame 3. The side parts 14 are provided at their rear ends with extensions 16 formed for example from discs or sheets. They cover the supports 6 from outside to the lower trim 7. The pivot pins 12 extend through the extensions 16. The side parts 14 and the extensions 16 are preferably simultaneously formed as side blinds, so that together with the bottom crossbar 15 they form a frame which outwardly surrounds the window frame 3. The extensions 16 at their lower sides are preferably provided with recesses or rounded corners 17 to allow the turning movements about the pivot pin 12 as shown in FIG. 4.

Each of the side parts 14 is provided at its inner side with an upper guide 18 which extends parallel to its longitudinal direction and formed as a groove or the like. The lateral ends of a conventional shutter apron 20 formed for example of shutter blades 19, lamellas and the like are slidingly guided in the guides 18 as shown in FIG. 1. Its rear end is mounted on the shutter shaft 11 and its front end can be mounted on a not shown pulling band guided in the side parts 14. The pulling bands can form a part of a not shown shutter actuating device and guided by rollers or the like supported in the bottom crossbar 15 to a tensioning and/or winding mechanism in the region of the shutter shaft 11. The rear ends of the guides 18 extend in front of the shutter shaft 11 as close as possible to the supports 6 in correspondence with the construction of the shutter in each individual case and its subsequently described operation. Alternatingly, the pulling bands can be mounted on a spring shaft supported in the bottom crossbar 15. The spring shaft can be rotatably supported in the lateral limiting walls of the bottom crossbar 15 and formed as a pulling device with a spring force aimed to pull the rolling shutter apron 20 in the direction of the closing position, or in other words, in the direction of the bottom crossbar 15. The operation of the spring shaft is analogous to the operation of conventional spring shafts used in inside blinds, however, the conventional ratchet device is not provided, so that the rolling shutter apron 20 in each position is under the action of a spring force. The spring force is preferably selected so as to provide substantially uniform spring properties over the whole movement of the rolling shutter apron web 20.

At least one projection 22 with a guiding pin 23 is provided at the front end of the window leaf 5 which turns away during opening of the roof window 2 outwardly. The guiding pin 23 extends in a guiding groove 24 formed in the side part 14 and extending parallel to the longitudinal direction. Preferably, such guiding pins 23 are provided at both lateral frame parts of the window leaf 5, and corresponding guiding grooves 24 are provided on both side parts 14. The combination of the guiding pin 23 and the guiding groove 24 acts so that during opening of the window leaf 5 the structural unit composed of the side parts 14, the extensions 16 and the bottom crossbar 15 is turned in the manner shown in FIG. 4 about the pivot pin 12.

Figure 2:
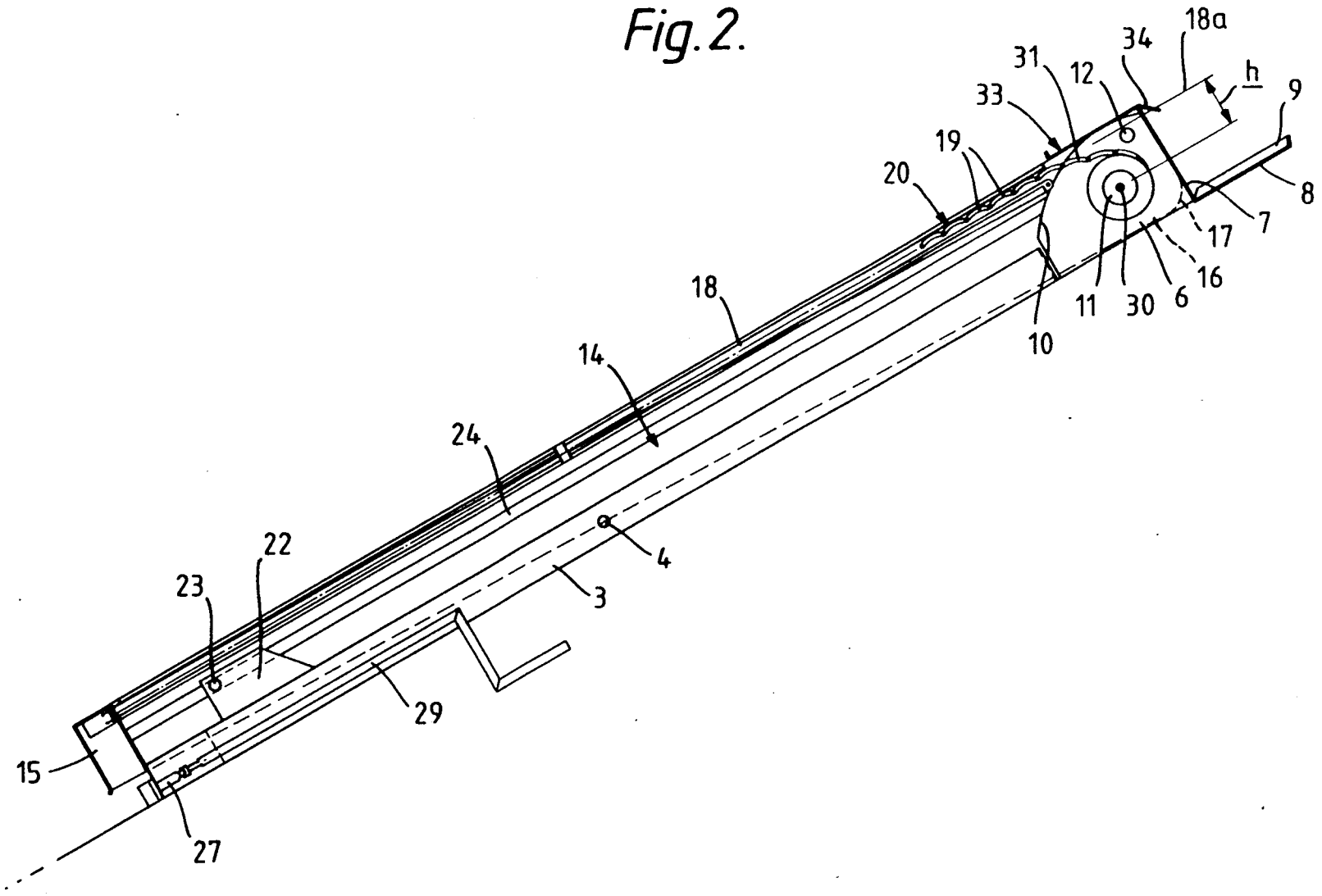
FIG. 2 is a schematic side view of a rolling shutter in accordance with the present invention from the right side with a closed roof window.
Figure 3:
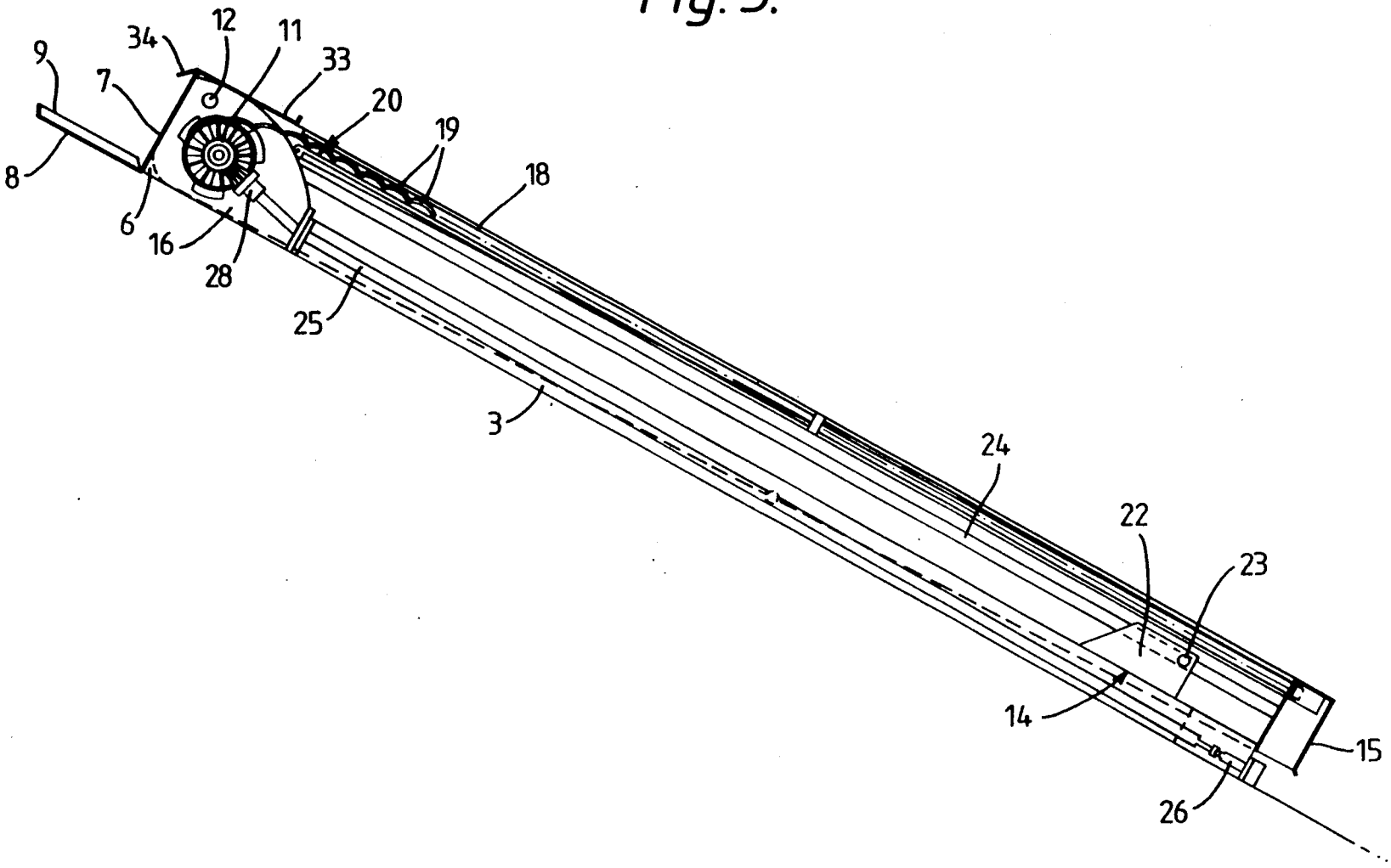
FIG. 3 is a schematic side view of the rolling shutter of FIG. 2 from the left side, also with the closed roof window.

The opening and the closing movements of the rolling shutter apron 20 can be controlled by a known rolling shutter actuating device which is fixedly connected with the rolling shutter shaft 11. Since the rolling shutter shaft 11 is supported in the fixedly mounted supports 6 and therefore does not influence the turning movement of the side parts 14, the actuating device can be designed in any desirable manner. An actuating element of the actuating device can be guided for example either near the rolling shutter shaft in the space provided with the roof window 2, or placed with the aid of the deviating elements guided along the lateral frame parts of the window frame 3, at the opposite end of the roof window 2. This is schematically shown in FIGS. 2–4 by bars 25, 26, 27 which are rotatably supported in the window frame 3 and lead from a toothed gear transmission 28 engaging the rolling shutter shaft 11 in FIG. 3 to an actuating element, for example a crank 29 (FIGS. 2, 4), a pulling cable and the like. It is activated in the case of open or closed window leaf 5 and from the space. An unauthorized sliding of the rolling shutter apron 20 from the guides 18 can be prevented for example by abutments arranged on them.

The operation of the inventive rolling shutter can be clearly recognized from FIGS. 2–4. In the closed condition of the window blade 5, the side parts 14 are held in their lower rotational position by the guiding pins 23. The rolling shutter apron 20 can be arbitrarily wound or unwound by the rolling shutter shaft 11. The rolling shutter apron 20 describes a convex curve 31 relative to the rotary axis 30 of the rolling shutter shaft 11, in the space located between the initial portion of the guides 18 and the rolling shutter shaft 11. The same is true with the open window leaf 5. It is therefore possible to arbitrarily turn the window leaf 5 with the closed, partially open and completely open rolling shutter apron 20. The condition that during opening a window leaf 5 the distance of the axis 30 of the rolling shutter shaft 11 from those ends of the guides 18 which face toward the rolling shutter shaft 11 is always somewhat greater, possesses no disadvantage since the piece of the rolling shutter apron 20 required for this can be wound with completely closed rolling shutter apron 20 from a remaining reserve located on the rolling shutter shaft 11. Moreover, many rolling shutter aprons 20 are supported in the region of a rolling shutter shaft 11 by a spiral spring, whereby an available rolling shutter apron reserve is provided. Regardless of this, the difference in the length of the rolling shutter apron 20 produced in the open and in the closed condition of the window leaf 5 in the above described construction is maintained so low that it amounts only to several centimeters.

For obtaining the desired operation with all provided turning positions of the window leaf 5 or the side parts 14, the side parts 14 are supported by the pivot pins 12 so that the above mentioned rear extensions 18*a* of the guides 18 shown in FIGS. 2 and 4 in all these turning positions have a substantially distance h from the axis 30 which at least corresponds substantially to the maximum coil radius of the rolling shutter shaft 11 with completely wound rolling shutter apron 20. In this case the rolling shutter apron 20 can be unwound independently tangentially of the rolling shutter shaft 11 and supplied to the guides 18 in a convex curve 31 whose instantaneous coil diameter is equal to the rolling shutter shaft 11, or in other words, independently of whether the rolling shutter 20 is located in its fully wound, fully unwound or an intermediate winding condition. Since the convex curve 31 moreover is substantially maintained in all turning positions of the side parts 14, the rolling shutter apron 20 cannot bend upwardly also in the conventional right-hand rotatable running device.

The above mentioned distance h can be for example maintained when the pivot pins 12 are arranged in the manner shown in FIGS. 2, 4 in the right upper corner of the support 6, and simultaneously the axis 30 of the rolling shutter shaft 11 lies substantially in the center, or in other words, before and under the pivot pins 12. Depending on the construction of the side parts 14 or the extensions 16, a plurality or further locations are provided at which the pivot pins 12 can be arranged for performing the desired task. Moreover, the expressions "substantially" and "somewhat" with respect to value h means that this value, depending on the respective construction, can be somewhat smaller than the maximum radius of the rolling shutter coil. As can be clearly seen from FIGS. 2 and 4, the device must be advantageously selected so that the respective portion of the rolling shutter apron 20 arranged between the rolling shutter shaft 11 and the initial part of the guides 18 is guided either in a plane identified by the extensions 18*a* and extending tangentially to the rolling shutter coil at the maximum coil radius, or describes the convex curve 31 shown in FIGS. 2 and 4.

For tightly covering the rolling shutter apron 20 and the rolling shutter coil located on it at least with the closed window leaf 5, the both side parts 14 are connected by an upper trim 33 extending over the width of the roof window 22. It can extend forwardly at least to the starting portion of the guides 18 substantially parallel to the window frame 3 in an unturned condition of the side parts 14, and provided with sealing lips extending in direction of the rolling shutter apron 20. The rear end of the upper trim 33 is preferably angled downwardly so that it covers the upper end of the lower trim 7, and at the same time does not prevent the turning of the side parts 14 shown in FIG. 4. For the same reason, the upper edges of the support 6 extend along the curve 10. Alternatingly the lower trim 7 can be shaped correspondingly and provided for example with an impression. Further blinds can be mounted on the stationary support 6 when desired.

With the aid of the upper trim 33 mounted on the side part 14 and the remaining blinds mounted on the supports 6, the space receiving the rolling shutter shaft 11 is substantially closed in a rain-proof and snow-proof manner, at least when the side parts are located in the non turned condition. Thereby in all turning positions the side parts 14 provide a free space 35 between the guides 18 and the rolling shutter shaft 11 as shown in FIG. 4, which allows the above described guidance of the rolling shutter apron 20 along the curve 31 in all turning positions.

The present invention has the advantage that due to the immovable support 6 there are no mounting problems for the actuating device, especially when it must have a hand crank as an actuating element, the rolling shutter apron 20 can be mounted in the conventional right hand rotatable device, no undesirable bending of the rolling shutter apron 20 during opening of the window leaf 5 occurs, and the part of the total device to be turned has a relatively low weight. Moreover, the supports 6 can be fixed above the roof window rigidly on the roof or on the window frame 3 and therefore formed so flat that it does not project upwardly beyond the side parts 14. .

The invention is not limited to the above described embodiment and can be modified in many different ways. This is especially true for the rolling shutter actuating device utilized in each individual case, some auxiliary devices or the above described spring shaft which can also be dispensed with and replaced with other means to secure a complete closing of the rolling shutter at such angles of inclination of the side parts 14 at which the rolling shutter apron 20 can not run due to its gravity force to the closing position. Furthermore, the invention is not limited to the turnable positioning of the structural unit composed of the side parts 14, the foot part 15, the upper trim 33, on the same supports 6 which carry the rolling shutter shaft 11. As can be seen particularly from FIG. 4, the extensions 16 of the side walls 14 can be turnably mounted on other supports, especially mounted behind the supports 6. Further, in deviation from FIGS. 2–4 it is not necessary to mount the upper trim 33 exclusively on the side parts 14. Depending on the position and arrangement of the pivot pin 12, it is further possible to mount at least a rear portion of the upper trim 33 fixedly on the supports 6 or the like, and to turn a front portion with the side parts 14. Finally, the invention can be used after a respective adaptation also for vertical wall windows or doors with a corresponding tiltable leafs.

It will be understood that each of the elements described above, or two or more together, may also find a useful application in other types of constructions differing from the types described above.

While the invention has been illustrated and described as embodied in a rolling shutter for a cover part of a wall or roof opening, especially for a roof window, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A rolling shutter for a roof or wall window, comprising an apron consisting of a plurality of shutter blades; a shaft for rolling up and unrolling said apron and being received in a substantially closed space; two spaced lateral supports fixed with respect to the window for rotatably but stationary supporting said shaft; means coupled to said shaft for rotating it and for thereby rolling up and unrolling said apron; two parallel side parts having rear extensions covering the supports from the outside, being rotatably supported for rotation about a stationary axis extending parallel to said shaft into provided turning positions, and including guides for guiding said apron in rolling-up and unrolling movements thereof and defining a plane; an upper trim extending between said two side parts and connected thereto for covering said apron from above; wherein said closed space is defined by said rear extension and said upper trim; wherein said plane in all rotational positions of said two side parts is spaced from said shaft by a distance; wherein said guides and said shaft define a free space therebetween; and wherein said plane, said distance and said free space are selected such that a damage-free movement of said apron is possible in any one of said provided turning positions of said side parts.

2. A rolling shutter as defined in claim 1, wherein said two side parts and said upper trim form an integral structural unit.

3. A rolling shutter as defined in claim 1, further comprising a lower trim formed integrally with said two lateral supports for attaching said rolling shutter to the window.

4. A rolling shutter as defined in claim 1, wherein at least one of said two side parts has a guiding groove extending over an entire length thereof for receiving a pin provided on the window leaf.

* * * * *